United States Patent [19]

Petricka

[11] Patent Number: 4,517,699

[45] Date of Patent: May 21, 1985

[54] PAINT ROLLER CLEANING APPARATUS

[75] Inventor: Ronald E. Petricka, Wyoming, Minn.

[73] Assignee: Deluxe Innovations, Inc., Wyoming, Minn.

[21] Appl. No.: 602,143

[22] Filed: Apr. 19, 1984

[51] Int. Cl.[3] ..... B08B 3/00

[52] U.S. Cl. ..... 15/104.04; 15/104.92; 68/213; 134/199

[58] Field of Search ..... 15/104.04, 104.92, 306 A, 15/302; 68/213; 134/138, 199

[56] References Cited

U.S. PATENT DOCUMENTS

| | | | |
|---|---|---|---|
| 1,357,730 | 11/1920 | Schaefer | 134/34 |
| 2,222,516 | 11/1940 | Powell et al. | 141/1 |
| 2,616,437 | 11/1952 | Secor | 134/122 |
| 2,985,178 | 5/1961 | Christensen, Jr. | 134/149 |
| 3,120,236 | 2/1964 | Ball | 134/100 |
| 3,421,527 | 1/1969 | Dettman | 134/138 |
| 3,577,280 | 5/1971 | George | 134/138 |
| 3,653,425 | 4/1972 | Elliott et al. | 15/302 X |
| 3,736,618 | 6/1973 | Ramsey | 15/306 A |
| 4,108,189 | 8/1978 | Claiborne et al. | 134/138 |
| 4,126,484 | 11/1978 | Monteiro | 134/34 |
| 4,130,124 | 12/1978 | Sherwin | 134/138 |
| 4,155,230 | 5/1979 | Lacher, Jr. | 68/213 |
| 4,172,373 | 10/1979 | Lary | 68/213 |
| 4,311,158 | 1/1982 | Harvey | 134/138 |
| 4,377,175 | 3/1983 | Fritz | 134/138 |
| 4,380,478 | 4/1983 | Cooney | 68/213 X |

OTHER PUBLICATIONS

World Tech Newsline (a technology marketing service of Control Data Corporation), vol. 5, No. 39, Apr./May 1981.

*Primary Examiner*—Chris K. Moore

*Attorney, Agent, or Firm*—Merchant, Gould, Smith, Edell, Welter & Schmidt

[57] ABSTRACT

A paint roller cleaning device (20) comprising an annular sleeve (22) adapted to have an interference fit with a pad on a roller (55) of a paint roller. The paint roller cleaning device (20) includes liquid passage means (28) within the annular sleeve (22), liquid entry means (36) to said liquid passage means (28) and liquid outlet means (38) communicating with the liquid passage means (28) on the inner surface (24) of the annular sleeve (22). A plurality of scrubber elements (44) are positioned circumferentially about the inner surface (24) of the annular sleeve (22) along a longitudinal portion thereof. The liquid entry means (36) includes a threaded cylindrical portion (42) in parallel orientation with the annular sleeve (22).

8 Claims, 5 Drawing Figures

PAINT ROLLER CLEANING APPARATUS

BACKGROUND OF THE INVENTION

The present invention relates to an apparatus for cleaning paint applicators and more particularly for cleaning roller-type paint applicators.

The use of roller applicators for applying paint is very popular as an even coating with a good finish is obtained. However, such paint rollers are difficult to clean and hence in many cases the rollers are used only a few times and then disposed of. This problem applies to both rollers used for water based paints, paints with solvent bases other than water, and other substances.

A roller after being used may be hand washed in a large excess of cleaning fluid. While this will remove surface paint on the roller pad or fabric cover, it will not efficiently remove paint or other deposits deep down in the pad at the core of the roller. Indeed, conventional means of flushing water over the fabric cover externally causes paint to be flushed deep into the cover, thereby never really cleaning the cover throughout. This deep down paint or deposit, if allowed to remain in the pad, can harden and significantly reduce the life and efficiency of the paint roller.

In addition, the roller cover core may be easily damaged by hand washing the fabric cover since many roller cores are made of paper products which are coated, but not strong enough to withstand the squeezing action during hand washing.

It is an object, therefore, of this invention to provide a cleaning device for a paint roller which will alleviate one or both of the problems mentioned above.

A paint roller cleaner device as shown in FIG. 1 of the specification currently exists in the marketplace. In addition to other differences, the present invention is designed so it can be screwed onto a faucet such that the roller is moved in a vertical motion through the cleaning device. Accordingly, the water or cleaning liquid flows evenly down and around the roller fabric cover or pad flushing the paint or other substance completely away rather than letting the paint settle at the bottom of the roller cover as is the tendency when the roller is moved in a horizontal direction through the paint roller cleaning device as with the device shown in FIG. 1 when mounted to a faucet. Additionally, the present invention includes scrubber elements about the circumference of a portion thereof. By rotating the roller with a left and right twisting motion as it is moved vertically through the cleaning device, a scrubbing action is imparted to the roller cover. This facilitates cleaning of hard to clean roller covers which often result when using a thick, sticky paint or substance or when the paint or substance has dried onto the roller cover.

Rollers are used for other applications such as glue or ink, or dampening rollers on printing presses. Cleaning of these rollers is time consuming and hence it is a further object of this invention to provide means to facilitate the cleaning of roller applicators in general.

SUMMARY OF THE INVENTION

The present invention relates to a paint roller cleaning apparatus for cleaning a roller pad of a paint roller. The paint roller cleaning apparatus includes an annular sleeve having an outer surface and an inner surface adapted to have an interference fit with the roller pad. Liquid passage means is provided within the annular sleeve intermediate of the inner and outer surfaces.

Liquid entry means is interconnected to the liquid passage means, the liquid entry means including a threaded cylindrical portion adapted for threaded attachment of the cleaning apparatus to a source of water or other liquid. The threaded cylindrical portion having a substantially parallel orientation with respsect to the annular sleeve. Liquid outlet means in communication with the liquid passage means is provided on the inner surface of the annular sleeve. A plurality of spaced, axially directed scrubber elements positioned circumferentially about the inner surface of the annular sleeve along at least a portion of the longitudinal extent thereof are provided.

In one embodiment of the present invention, the liquid outlet means includes a slot disposed circumferentially about the inner surface of the annular sleeve whereby a continuous impingement jet of liquid is provided against the pad of the paint roller.

Yet another feature of one embodiment is the inclusion of a threaded cylindrical portion oriented generally parallel to the annular sleeve such that the paint roller may be moved vertically through the annular sleeve. As previously discussed, this causes the water or cleaning liquid used to flow evenly down and around the roller pad so as to completely flush away the paint or other substance present rather than letting the paint settle on one side of the roller pad as is the tendency when the roller is moved in a horizontal direction through the paint roller cleaning apparatus taught by the device shown in FIG. 1 when mounted to a faucet.

Yet another advantageous feature of the preferred embodiment of the present invention is the inclusion of scrubber elements circumferentially positioned about the inner surface of the annular sleeve. By rotating the roller with a left and right twisting motion as it is moved vertically through the cleaning apparatus, a scrubbing action is imparted to the roller pad or fabric cover. As previously discussed, this facilitates cleaning of hard to clean roller pads.

Additionally, the scrubber elements can be used to effectively fluff up a dry roller fabric cover. The fabric of a roller cover after being washed, has a tendency to dry in a matted state. The scrubber elements can be used to fluff up the fabric by moving the roller fabric cover through the cleaning apparatus with a vertical and left and right twisting action.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE PREFERRED EMBODIMENT

Figure 1:
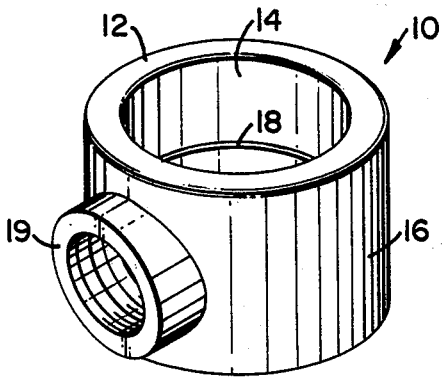
FIG. 1 is a perspective view of a prior art paint roller cleaning apparatus.

Referring now to FIG. 1, a prior art paint roller cleaning apparatus is shown, the cleaning apparatus being generally designated by the reference numeral 10. The paint roller cleaning apparatus includes an annular sleeve 12 having an inner surface 14 and an outer surface 16 spaced therefrom. The inner and outer surfaces 14, 16 define a space for liquid passage. Positioned circumferentially about the annular sleeve 12 on the inner surface 14 is a slot 18 defining a liquid outlet. Interconnected to the outer surface 16 and extending radially therefrom is a threaded cylindrical portion 19 defining a liquid inlet passage in communication with the passage between the inner and outer surfaces 14, 16. Accordingly, the paint roller cleaning apparatus shown in FIG. 1 can be threadedly attached to a source of cleaning liquid. However, when attached to a source of cleaning liquid, the annular sleeve 12 has a horizontal orientation such that the paint roller is moved horizontally through the paint roller cleaning apparatus 10. Accordingly, the paint or other substance embedded in the paint roller pad has a tendency to settle at the bottom of the cleaner pad due to the effect of gravity. Additionally, when the paint roller cleaning apparatus 10 is attached to a faucet or the like of a cleaning tub, the sides of the tub have a tendency to interfere with the horizontal movement of the paint roller pad.

Additionally, the inner surface 14 of the paint roller cleaning apparatus 10 is relatively smooth. Accordingly, other than the impinging jet-like stream from the slot 18, there is no scrubbing action imparted to the roller pad.

Figure 2:
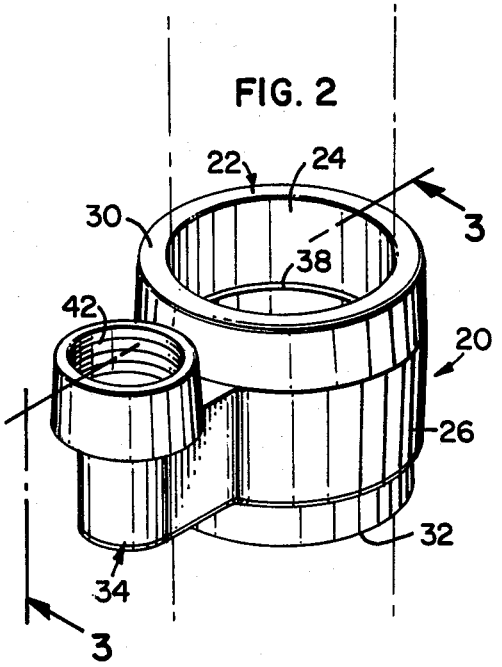
FIG. 2 is a perspective view of an embodiment of a paint roller cleaning apparatus in accordance with the principles of the present invention.
Figure 3:
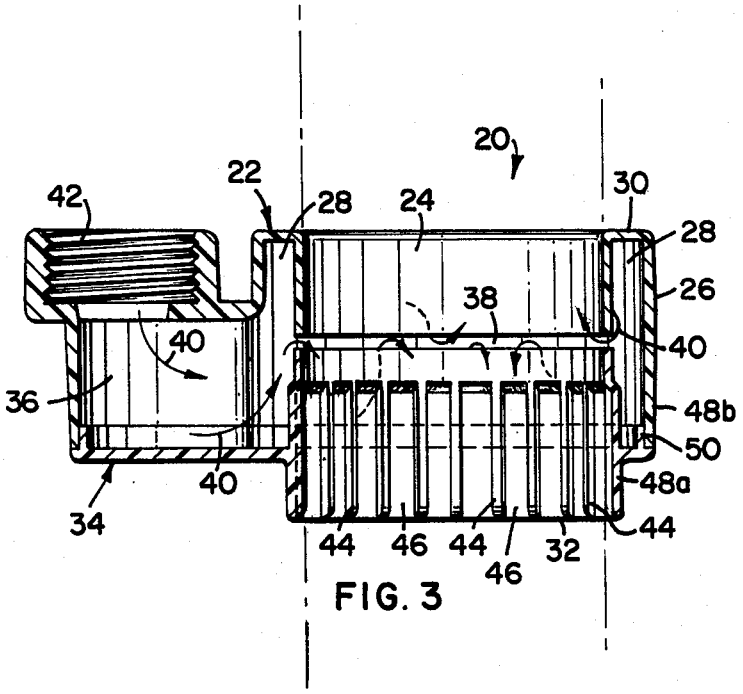
FIG. 3 is a cross sectional view taken generally along line 3—3 of FIG. 2.

Illustrated in FIGS. 2 and 3 is a preferred embodiment of the present invention, generally being designated by the reference numeral 20. The paint roller cleaning apparatus shown includes an annular sleeve 22 having an inner surface 24 and an outer surface 26 radially spaced therefrom so as to define an annular fluid passage 28. The annular sleeve 22 includes an enclosed top end 30 and an enclosed bottom end 32. Interconnected to the outer surface 26 is a portion 34 providing for attachment of the paint roller cleaning apparatus 20 to a source of water or other cleaning liquid. The portion 34 defines a passageway 36 in communication with the annular passage 28. In addition, extending circumferentially about the annular sleeve 22 on the inner surface 24 is a slot 38 defining a passageway out of the annular sleeve 22. Accordingly, as illustrated in FIG. 3, water or other cleaning liquid as generally illustrated by the arrows 40 is able to flow from the source of the water through the passage 36 into the annular passage 28 and out the slot 38 when the cleaning apparatus 20 is suitably interconnected to a source of water or other cleaning liquid. The portion 34 includes an internally threaded cylindrical portion 42 enabling the cleaning apparatus 20 to be threadedly attached to a faucet or garden hose or the like.

As generally illustrated in FIG. 3, the cleaning apparatus 20 includes a plurality of spaced apart, axially extending scrubber elements 44 on the inner surface 24 along the lower portion thereof. The scrubber elements 44 are separated by recessed portions 46 of greater width than the scrubber elements 44. In the embodiment shown, the scrubber elements 44 extend from the bottom end 32 to just below the circumferential slot 38. Further, the scrubber elements 44 have an inwardly facing surface which is flush with the inner surface 24.

One embodiment of the present invention is made from a molded plastic material. The cleaning apparatus 20 being molded in two separate sections 48*a* and 48*b* which are suitably secured to one another generally at the location 50 by various methods such as sonic welding.

Figure 4:
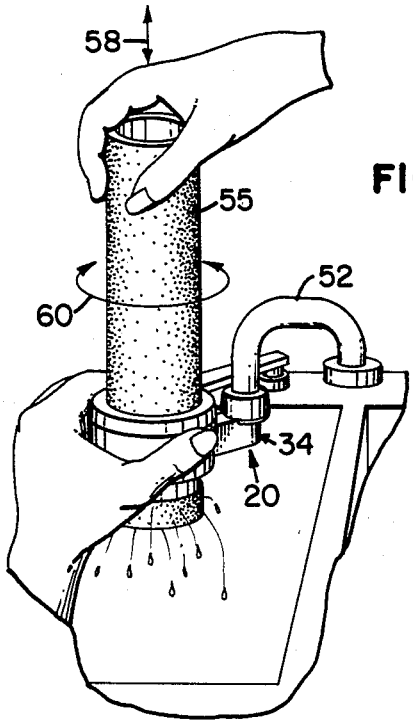
FIG. 4 is a perspective view of the embodiment shown in FIG. 2 in use on a faucet, the roller pad being removed from the handle portion of the roller.
Figure 5:
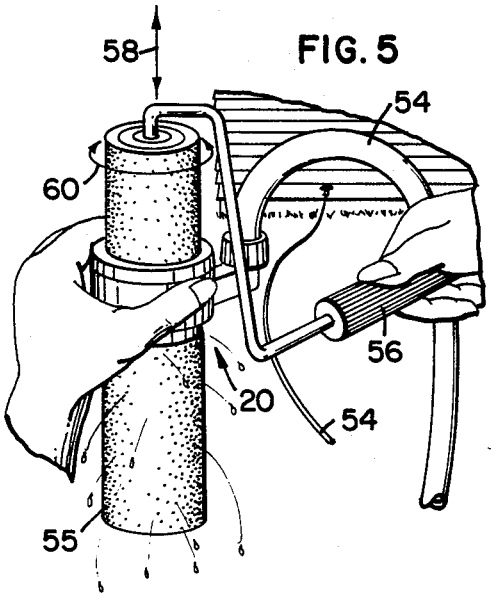
FIG. 5 is a perspective view of the embodiment shown in FIG. 2 in use on a garden hose, the roller pad being mounted on the handle portion of the roller.

The embodiment of the present invention shown in FIGS. 2-3 is illustrated in actual use in FIGS. 4 and 5. In FIG. 4, the cleaning apparatus 20 is threadedly interconnected to the end of a faucet 52 whereas in FIG. 5, the cleaning apparatus is threadedly interconnected to the end of a garden hose 54. In FIG. 4, the operator is using his or her hands to vertically move, as illustrated by the arrow 58, and twist, as illustrated by the arrow 60, a roller pad 55 in the cleaning apparatus 20 whereas in FIG. 5 the user is using a handle portion 56 of the paint roller to vertically move and twist the roller pad 55 in the cleaning apparatus 20. In FIG. 5, the user is supporting the cleaning apparatus 20 with his or her hand as opposed to FIG. 4 wherein the cleaning apparatus 20 is supported by the faucet 52. It is anticipated that a user might use his or her hand for movement of the roller pad 55 for more difficult cleaning jobs.

The present invention thus provides a cleaning apparatus which does not damage the roller core. In addition, cleaning apparatus 20 forces the water or other cleaning liquid directly into and through the roller pad or fabric cover and flushes the paint out from within the fabric cover or pad at the core of the roller as well as along the sides thereof. In addition, the preferred embodiment of the present invention enables the roller pad to be moved in a vertical motion. This allows the water to run down and around the pad flushing the paint off rather than letting it settle and run back into the fabric cover. The preferred embodiment of the present invention provides a scrubbing action upon rotating the roller pad therein with a left and right motion. This is particularly efficient for hard to clean roller pads wherein the paint or other substance has dried onto the fabric cover.

It will be appreciated that alternate embodiments in keeping with the principles of the present invention might be utilized. For example, the circumferential slot 38 might be replaced by a plurality of apertures so as to provide a plurality of impinging water or liquid streams onto the pad of the paint roller. In addition, the paint roller cleaning apparatus might include a handle thereon so that it may be easily used when connected to a hose. Furthermore, with some types of paint and other substances, it may be advantageous to supply detergent along with the cleaning fluid to assist with the cleaning of the paint roller and therefore in various embodiments of the present invention, there may be included detergent dispensing structures.

It will be appreciated from the above that using an annular sleeve fitting with an interference fit around the cylindrical shape of a paint roller pad in effect limits egress of cleaning liquid from the circumferential slot 38 so that the cleaning fluid or water is forced more effectively to enter deep within the porous structure of the pad and hence cause a much more effective cleaning action.

Furthermore, the present invention also relates to the method of cleaning the pad of a roller which includes the steps of locating the pad with an interference fit within the annular sleeve 22 of a paint roller cleaning device, causing a cleaning fluid or water under pressure to eject through the circumferential slot 38 and into the roller pad, and moving the roller pad vertically and in a right and left twisting action.

It is to be understood, however, that even though numerous characteristics and advantages of the invention have been set forth in the foregoing description, together with details of the structure and function of the invention, the disclosure is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A roller cleaning apparatus for cleaning a roller pad of a roller, comprising:

(a) an annular sleeve having an outer surface and an inner surface adapted to have an interference fit with the roller pad;

(b) liquid passage means within said sleeve intermediate of said inner and outer surfaces;

(c) liquid entry means interconnected to said liquid passage means, said liquid entry means including a threaded cylindrical portion adapted for threaded attachment of the cleaning apparatus to a source of water or other liquid, said threaded cylindrical portion having a substantially parallel orientation with respect to said annular sleeve;

(d) liquid outlet means on the inner surface of said annular sleeve communicating with said liquid passage means; and (e) a plurality of spaced, axially directed scrubber elements positioned circumferentially about the inner surface of said annular sleeve along at least a portion of the longitudinal extent of the inner surface.

2. An apparatus in accordance with claim 1, wherein said liquid outlet means includes a slot disposed circumferentially of the inner surface of said annular sleeve.

3. An apparatus in accordance with claim 2, wherein said liquid entry means is interconnected to the outer surface of said annular sleeve and includes a 90 degree bend so as to define an elbow-like structure.

4. An apparatus in accordance with claim 2, wherein said scrubber elements extend from a bottom end of said annular sleeve to proximate said circumferential slot.

5. An apparatus in accordance with claim , wherein recessed portions are disposed intermediate of adjacent ones of said scrubber elements, said scrubber elements having an inner surface substantially flush with the inner surface of said annular sleeve.

6. An apparatus in accordance with claim 5, wherein said recessed portions have a greater circumferential width than said scrubber elements.

7. An apparatus in accordance with claim 1, wherein the paint roller cleaning apparatus is made of a molded plastic material.

8. A roller cleaning apparatus for cleaning a roller pad of a roller, comprising:

(a) an annular sleeve having an outer surface and an inner surface adapted to have an interference fit with the roller pad;

(b) liquid passage means within said annular sleeve intermediate of said inner and outer surfaces;

(c) liquid entry means interconnected to said liquid passage means, said liquid entry means including a threaded portion for threaded attachment of the cleaning apparatus to a source of water or other liquid;

(d) liquid outlet means communicating with the liquid passage means on the inner surface of said annular sleeve, said liquid outlet means including a slot disposal circumferentially of the inner surface of said annular sleeve; and (e) a plurality of spaced, axially directed scrubber elements positioned circumferentially about the inner surface on said annular sleeve along at least a portion of the longitudinal extent of the inner surface, said scrubber elements being located at least partially below said slot.

* * * * *

UNITED STATES PATENT AND TRADEMARK OFFICE

CERTIFICATE OF CORRECTION

PATENT NO. : 4,517,699

DATED : May 21, 1985

INVENTOR(S) : RONALD E. PETRICKA

It is certified that error appears in the above-identified patent and that said Letters Patent is hereby corrected as shown below:

Column 2, line 6, "respsect" should be --respect--;

Column 6, line 11, after "claim" insert --1--.

Signed and Sealed this

*Eighth* Day of *July 1986*

[SEAL]

*Attest:*

DONALD J. QUIGG

*Attesting Officer*

*Commissioner of Patents and Trademarks*